United States Patent [19]

Johansson et al.

[11] 4,351,255

[45] Sep. 28, 1982

[54] ICE-BREAKING SHIP

[75] Inventors: Bengt Johansson, Calgary, Canada; Arno Keinonen, Kerava; Eero Mäkinen, Espoo, both of Finland

[73] Assignee: Oy Wartsila AB, Helsinki, Finland

[21] Appl. No.: 974,108

[22] Filed: Dec. 27, 1978

Related U.S. Application Data

[63] Continuation-in-part of Ser. No. 826,674, Aug. 22, 1977, abandoned, which is a continuation of Ser. No. 594,491, Jul. 9, 1975, abandoned.

[51] Int. Cl.[3] ..... B63B 35/08

[52] U.S. Cl. ..... 114/41; 114/56; 114/356

[58] Field of Search ..... 114/40, 41, 42, 43, 114/56, 57, 63, 64, 65 R, 67 R; 9/6 R, 6 M

[56] References Cited

U.S. PATENT DOCUMENTS

| | | | |
|---|---|---|---|
| 3,438,350 | 4/1969 | Gallin | 114/56 |
| 3,636,904 | 1/1972 | Blanchet | 114/41 |
| 3,762,354 | 10/1973 | Waas | 114/41 |
| 3,888,200 | 6/1975 | Wendorf | 114/56 |

*Primary Examiner*—Trygve M. Blix
*Assistant Examiner*—Jesus D. Sotelo
*Attorney, Agent, or Firm*—Martin Smolowitz

[57] ABSTRACT

In an ice-breaking ship, having sufficient power and being generally designed for efficient ice-breaking, the breaking of the ice is made more effective by changing the zone of ice crushing and shearing which occurs at the stem during normal ice-breaking of level ice, to a zone where the breaking occurs due to bending. This is obtained by forming the front portion of the ship so that at least within the area where the stem contacts and breaks level ice, the basically wedge-formed stem is truncated to form a relatively broad runner-like portion being inclined forwards in a relatively small angle to the water line plane of the ship. The width of the runner-like portion is determined in conformity with the general ice-breaking ability of the ship, whereby the driving power (P) of the ship, in kW, and the maximum beam (B) of the ship at its design water line, in meters, forms the basis for calculating, in meters, the width (W) of the runner-like portion by means of the formula:

$$W=(0.02 \text{ to } 0.08)(P/B)^{0.63}.$$

11 Claims, 7 Drawing Figures

ICE-BREAKING SHIPsp

This application is a continuation-in-part of co-pending application Ser. No. 826,674 filed Aug. 22, 1977, which is a continuation of application Ser. No. 594,491 filed July 9, 1975, both now abandoned.

BACKGROUND OF THE INVENTION

The invention relates to an ice-breaking ship, and more particularly, to the form of the bow portion of the ship.

The bow portion of a ship is usually rather sharp, and up to now also the bow of ice-breakers and corresponding ships has been made sharp. The object of making the bow sharp has been to keep the resistance of movement in water at a low level, and to improve the ice breaking properties of the ship, since the general opinion has been that a sharp bow breaks the ice better in front of the ship.

However, this assumption is not quite correct. It is certainly true that a sharp bow crushes the ice well, but on the other hand, the breaking of the ice by means of bending the ice downwards requires less power than the crushing of the ice to small pieces. In an ordinary ice-breaker the side portions of the bow break the ice by bending it downwards, but exactly at the stem a zone is formed where the ice does not break due to bending, but is crushed and sheared into pieces, due to the advancement of the sharp bow.

It has been shown that a ship accoding to the invention uses in average considerably less energy to break the ice than a ship provided with a traditional ice-breaking bow. In this connection it should be noted that in Finnish patent specification No. 50400, a round bow form has been suggested for an ice-breaking ship, but this kind of round bow differs considerably from the invention, because a bow according to the invention has considerably better ice-breaking properties than a traditional bow, but the earlier suggested round bow does not have better ice-breaking properties than a traditional bow. The advantages of the round bow are based on the fact that the displacement increases while the outer dimensions and the ice-breaking properties remain unchanged.

SUMMARY OF THE INVENTION

The object of the invention is to make the breaking of ice more effective and less power-consuming than in known ships. This is obtained by giving the bow portion of the ship a special form which will be described in detail in the following. It should be understood, however, that more or less similar bow formations may occur in known vessels of such a kind that they cannot be used for efficient ice-breaking due to their small size, small driving power, weak constructional strength, ect. Such vessels do not form any anticipation of the inventive concept because these ships were never designed for and cannot be used for efficient ice-breaking, and hence, occasional geometrical similarity with a bow form according to the invention has no technical meaning because the ice-breaking properties of such vessesls, which cannot be used under severe ice conditions, can never by properly determined. In order to clearly distinguish the invention from vessels without interest within the field of efficient ice-breaking a number of features must be stated for determining the field within which the invention can be successfully used and reduced to practice. The field of the invention is determined as follows.

A ship according to the invention has a drive machinery driving a number of submerged propellers and has a beam of its design water line of at least 10 meters. The power of the drive machinery is adapted to the beam of the ship in accordance with the formula:

$$P \geqq 740 + 45(B-10)1.5,$$

wherein

P = the total maximum driving power output of the drive machinery of the ship, in kW, measured at the shafts of said propellers, and B = the maximum beam of the ship at its design water line, in meters.

A ship of the kind defined above is improved according to the invention by giving its basically wedge-formed stem portion a truncated form at least within an area between the design water line of the ship and half its draft, so as to form a runner-like front portion being inclined forwards in a relatively small angle to the design water line plane of the ship and having a width of at most one third of the beam B of the ship, as defined above, and being otherwise adapted to the general ice-breaking ability of the ship in accordance with the formula:

$$W = (0.02 \text{ to } 0.08)\ (P/B)0.63,$$

wherein

W = the width of said runner-like portion, in meters, and P and B are as defined above.

The range 0.02 to 0.08 of the first factor gives maximum and minimum limits of the width W. Of this range preferably only the portion 0.02 to 0.04 should be used, which in most cases gives the best result.

The design water line of a ship is always determined already when a ship is designed. In some cases a ship may have two water lines, one full load line and one ballast line. If the term "water line" is not specified, it always means the uppermost water line, that is, the full load line of the ship. This is also the case in this specification and in the claims. The design draft is the draft of the ship when it is trimmed to float on its design water line.

A ship according to the invention can be further improved by giving it a design draft in accordance with the following formula:

$$T \geqq 1.5 + 0.05(B-10),$$

wherein

T = the design draft of said ship, in meters, and

B = the maximum beam of said ship at its design water line, in meters.

The draft of a ship has an inportant influence on its ice-breaking ability because very shallow ships are poor ice-breakers.

Normally, the runner-like portion should have a distinctly vertically elongated form when viewed from the front of the ship in a direction parallel to the design water line plane of the ship. At least the runner-like portion should be several times longer than it is broad when measured in the lengthwise direction of the runner-like portion and perpendicularly thereto, respectively. This will give the bow portion of the ship a natural form and give it good ice-breaking qualities as well as good properties when moving in free water.

In an ice-breaking bow, the angle between the stem line and the water line plane of the ship should always be small, at least close to and below the water line. In a ship according to the invention the best results are obtained, if this angle is between 15° and 50°, preferably between 20° and 45°. This angle can be enlarged almost directly above the design water line of the ship in order to obtain a more practical bow form.

It is also usual, in some types of ice-breaker, to make the lowest portion of the stem line almost vertical. This portion of the bow is below half the draft of the ship and has no influence on the application of the invention. It is usually not necessary to have a runner-like bow form below half the draft of a ship.

The smaller the angle between the stem line and the water line is, the smaller is the optimum width of the runner-like portion. Since a broad runner-like portion increases the resistance to movement in water, it is of advantage to try to make the angle small between the stem line and the water line so that the runner-like portion does not have to be unnecessary broad.

The expression "runner-like" has been chosen to describe the front portion of the bow of a ship according to the invention because this portion is in fact very much like the runner of a sledge. A sledge runner is usually plane, but it does not have to be plane, it can also be slightly rounded. Especially the edges of the actual runner surface are often rounded off, at least to some extent. The same forms can with advantage be used in the runner-like portion of a ship according to the invention. Preferably, the runner-like portion of the bow is made plane or substantially plane. If the runner-like portion is made plane over its whole width, a sharp corner is formed between the runner-like portion and the side surface of the bow. Such a sharp corner has good as well as bad properties. As regards the strength of the construction sharp corners are not favourable. In addition, any sharp corner in the bow portion may cause the same type of crushing and shearing of the ice as a sharp bow. A sharp corner is, however, advantageous when the ship wants to leave a broken-up channel because the sharp corner penetrates into the ice at the side of the broken-up channel and prevents the ship from sliding along the edge of the channel. Since the sharp corners of the runner-like portion may have a harmful effect, it is in many cases better no to make the runner-like portion totally plane. Hence, the edges of the runner-like portion can be rounded off and the portion between the edges can also be made somewhat convex.

It is rather important that the runner-like portion has a smooth surface and remains smooth so that the friction between the runner and the ice remains small. In order to make this possible, a suitable material should be chosen for the runner-like portion. It has been established that stainless steel is a useful material since it can be easily welded to the other parts of the hull of the ship. It is, of course, sufficient that only that part of the runner-like portion which slides against ice is made smooth. This means in practice that only the portion from just above the design water line downwards to about half the draft of the ship has to be made smooth.

The optimum value of the width of the runner-like portion is, of course, the most important. The optimum value is dependent on the thickness of the ice to be broken, and hence, cannot be reached for all kinds of ice. Usually, an ice-breaking ship is designed for a certain maximum ice thickness. Dependent on the circumstances the best results are usually considered to be obtained if the width of the runner-like portion is 0.5 to 1.5 times the thickness of the thickest level ice to be broken. In order to indicate how to find this value on the sole basis of the design parameters of a ship the second formula of page 4 has been invented. This formula makes it possible to calculate a suitable width for the runner-like protion already at the design stage without the necessity of performing full scale tests under severe ice conditions.

Other objects, advantages and the nature of the invention will become readily apparent from the detailed description of the invention taken in conjunction with the accompanying drawings.

DESCRIPTION OF THE PREFERRED EMBODIMENTS

Figure 3:
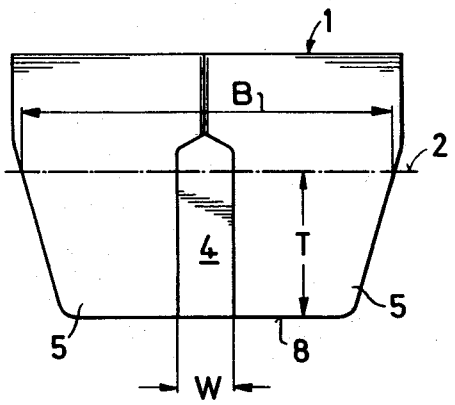
FIG. 3 shows a front view of the ship of FIG. 1.

In the drawings, numeral 1 indicates the hull of a ship, 2 the design water line 3 and the stem line of the ship. From FIG. 1 it is evident that the angle a between the stem line 3 and a plane parallel to the water line 2 within an area close to the water line and below the water line is relatively small. In the embodiment shown in the drawings, this angle is about 30°. The upper most part of the bow can be freely designed, since it does not usually come into contact with level ice to be broken.

Figure 1:
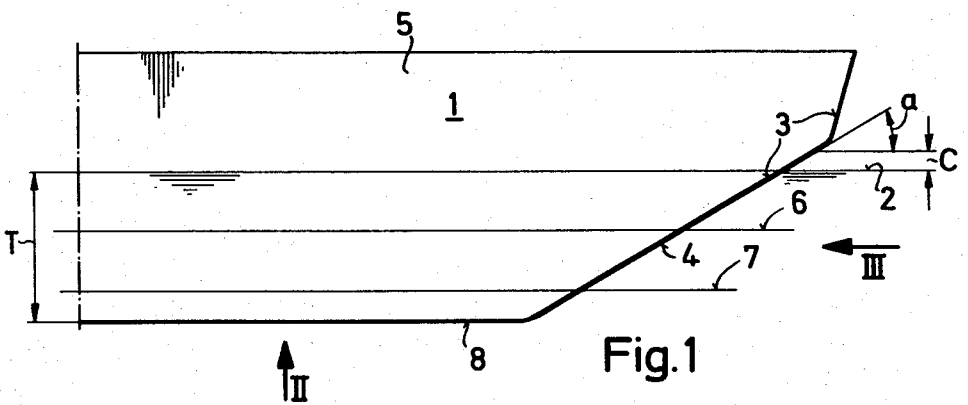
FIG. 1 shows a side view of the front part of an exemplary ship according to a first embodiment of the invention.
Figure 2:
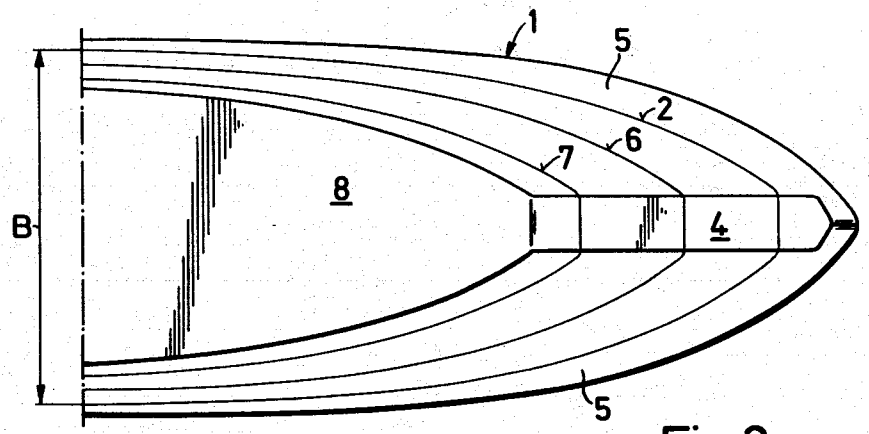
FIG. 2 shows a bottom view of the ship of FIG. 1.
Figure 4:
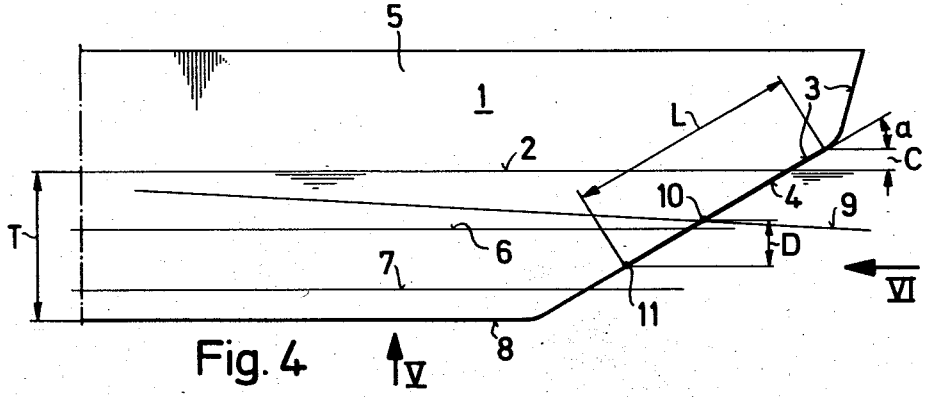
FIG. 4 shows a side view of the front part of an exemplary ship according to a second embodiment of the invention.
Figure 5:
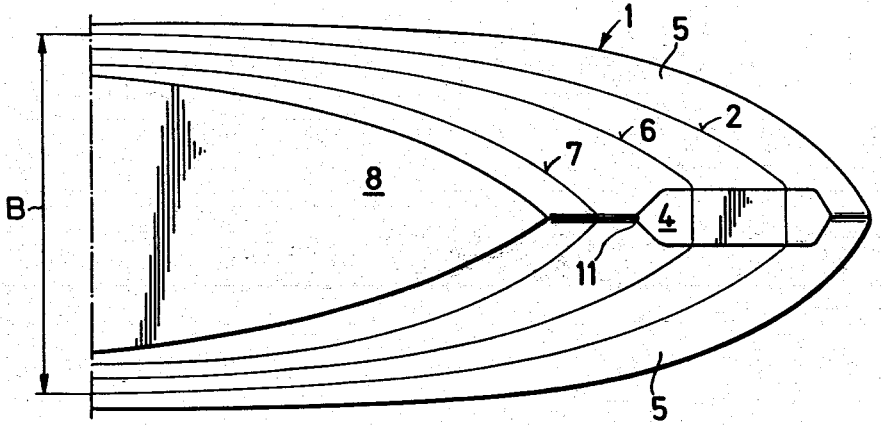
FIG. 5 shows a bottom view of the ship of FIG. 4.

In order to give a better representation of the form of the ship shown in the drawings two horizontal planes 6 and 7 have been indicated between the design water line 2 and the bottom surface 8 of the ship in FIGS. 1 and 4. In FIGS. 2 and 5 the planes 6 and 7 are represented by the line of intersection between the hull 1 and the said planes. The maximum beam B of the hull at the design water line 2 is indicated in FIGS. 2, 3, 5 and 6 and the draft of the ship T is indicated in FIGS. 1, 3, 4 and 6.

In the embodiment shown in FIGS. 1 to 3 a runner-like portion 4 has been formed in the front of the ship from a point at a vertical distance C above the design water line 2 to the bottom 8 of the ship. The distance C approximately equals the thickness of the level ice to be broken.

Figure 6:
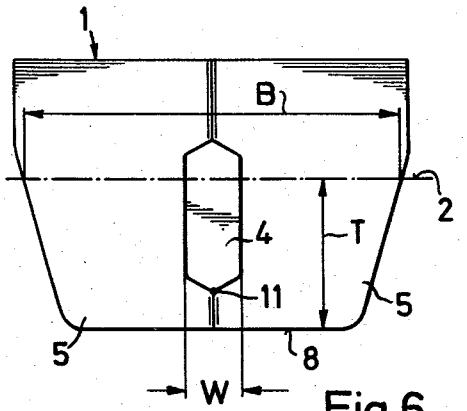
FIG. 6 shows a front view of the ship of FIG. 4.

In the embodiment shown in FIG. 4 to 6 the length L of the runner-like portion 4 is relatively shorter than in the embodiment shown in FIGS. 1 to 3. Also in this embodiment the runner-like portion 4 starts at the distance C above the design water line 2, but ends at a level approximately at half the draft T of the ship. In many cases it is quite sufficient to end the runner-like portion 4 at half the draft of the ship, but if it is desired to determine more exactly at what level the runner-like portion should end if a minimum length L is aimed at, the following calculation should be made. A line 9 should be drawn to indicate the lowest possible water line during ice breaking, when the trimming of the vessel and the lifting force of the ice is taken into account. From the point of intersection 10 between this line 9 and the stem line 3 a vertical distance D which corresponds to two times the thickness of the thickest level ice to be broken should be measured downwards in order to find the lowest point 11 of the runner-like portion 4.

Figure 7:
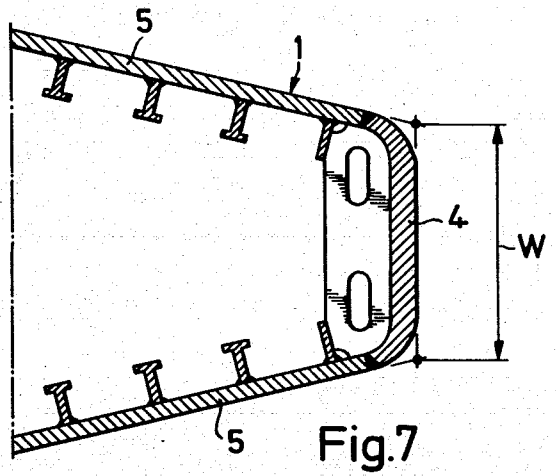
FIG. 7 shows on an enlarged scale a horizontal section at the position of the design water line of the front part of the ships shown in FIGS. 1 to 6.

From FIG. 7 it is evident that runner-like portion 4 of the bow is made almost plane, but is still somewhat rounded off. The front surface of the portion 4 still substantially has the nature of a flat surface. Such a flat surface is able to bend down the ice in front of the ship until the ice is broken due to the bending, and is not crushed or sheared as would be the case if the bow would be sharp in the usual way.

At least the outer surface of the portion 4 is preferably made of stainless steel, while the sides 5 of the ship are made of ordinary ship steel plates. The dimensions of the constructional elements are exaggerated in FIG. 7 in order to obtain a clearer representation.

The width W of the runner-like portion 4 is chosen in accordance with the thickness of the ice to be broken as has already been explained. In great ice-breakers the value of W may be about 2 m, but it is also feasible that the portion 4 is made still broader.

The invention is not limited to the embodiments shown, but variations thereof are feasible within the scope of the attached claims.

We claim:

1. A ship having efficient ice-breaking properties, a basically wedge-formed stem portion and a drive machinery driving a number of submerged propellers, the beam of said ship, at its design water line, being at least 10 m and the power of its drive machinery being adapted to the beam of the ship in accordance with the following formula:

$$P \geqq 740+45(B-10)1.5,$$

wherein

P = the total maximum driving power output of said machinery, in kW, measured at the shafts of said propellers, B = the maximum beam of the ship at its design water line, in meters;

the improvement comprising a modification of said basically wedge-formed stem portion including a truncation thereof, at least within an area between the design water line of the ship and half its draft, whereby a runner-like front portion is formed at a position suitable for striking and bending downwards level ice, said runner-like portion being a smooth surface and being several times longer than it is broad when measured in its lengthwise direction and perpendicularly thereto, respectively, and being inclined forwards in a relatively small angle to the design water line plane of the ship, said runner-like portion also having a width of at the most one third of the beam B of the ship, as defined above, and being otherwise adapted to the general ice-breaking ability of the ship in accordance with the following formula:

$$W=(0.02 \text{ to } 0.08)(P/B)0.63,$$

wherein

W = the width of said runner-like portion, in meters, and P and B are as defined above.

2. A ship as claimed in claim 1, wherein the width of the runner-like portion is determined by the formula $$W=(0.02 \text{ to } 0.04)(P/B)0.63,$$

wherein W, P and B are as defined in claim 1.

3. A ship as claimed in claim 1 or 2, wherein the design draft of said ship is in accordance with the following formula:

$$T \geqq 1.5+0.05(B-10),$$

wherein

T = the design draft of said ship, in meters,

B = the maximum beam of said ship at its design water line, in meters.

4. A ship as claimed in claim 1 or 2, wherein said runner-like portion has a distinctly vertically elongated form when viewed from the front in a direction parallel to the design water line plane of said ship.

5. A ship as claimed in claim 1 or 2, wherein said runner-like portion is inclined forwards at an angle of 15° to 50° with respect to the design water line plane of said ship.

6. A ship as claimed in claim 1 or 2, wherein the angle between said runner-like portion and the design water line plane of said ship is 20° to 45°.

7. A ship as claimed in claim 1 or 2, wherein said runner-like portion is at least substantially plane.

8. A ship as claimed in claim 1 or 2, wherein said runner-like portion within an area between the design water line and one-half of the draft of said ship has a smooth surface and is made of such a material that said surface remains at least substantially smooth.

9. A ship as claimed in claim 1 or 2, wherein at least a part of the front area of said runner-like portion is made of stainless steel.

10. A ship as defined in claim 1 wherein the design draft of said ship is in accordance with the following formula:

$$T \geqq 1.5+0.05\ (B-10),$$

wherein

T = the design draft of said ship, in meters,

B = the maximum beam of said ship at its design water line, in meters;

said runner-like portion having a distinctly vertically elongated form when viewed from the front in a direction parallel to the design water line plane of said ship; said runner-like portion being inclined forwards at an angle of 15° to 50° with respect to the design water line plane of said ship; said runner-like portion being at least substantially plane; said runner-like portion within an area between the design water line and one-half of the draft of said ship having a smooth surface and being made of such material that said surface remains at least substantially smooth; at least part of the front area of said runner-like portion being made of stainless steel.

11. A ship having efficient ice-breaking properties, a basically wedge-formed stem portion and a drive machinery driving a number of submerged propellers, the beam of said ship, at its design water line, being at least 10 m and the power of its drive machinery being adapted to the beam of the ship in accordance with the following formula:

$$P \geqq 740 + 45(B - 10)1.5,$$

wherein

P = the total maximum driving power output of said machinery, in kW, measured at the shafts of said propellers, B = the maximum beam of the ship at its design water line, in meters;

the improvement comprising a modification of said basically wedge-formed stem portion including a truncation thereof, at least within an area between the design water line of the ship and half its draft, whereby a runner-like front portion is formed at a position suitable for striking and bending downwards level ice, said runner-like portion being several times longer than it is broad when measured in its lengthwise direction and perpendicularly thereto, respectively, and being inclined forwards in a relatively small angle to the design water line plane of the ship, said runner-like portion also having a distinctly vertically elongated form when viewed from the front in a direction parallel to the design water line plane of said ship and having a width of at the most one third of the beam B of the ship, as defined above, and being otherwise adapted to the general ice-breaking ability of the ship in accordance with the following formula:

$$W = (0.02 \text{ to } 0.08)(P/B)0.63,$$

wherein

W = the width of said runner-like portion, in meters, and P and B are as defined above.

* * * * *

UNITED STATES PATENT AND TRADEMARK OFFICE

CERTIFICATE OF CORRECTION

PATENT NO. : 4,351,255

DATED : September 28, 1982

INVENTOR(S) : Bengt Johansson, Arno Keinonen, Eero Makinen

It is certified that error appears in the above-identified patent and that said Letters Patent is hereby corrected as shown below:

In the title page of the issued patent, Column 1, after "[22] Filed: Dec. 27, 1978", insert on the next two lines --Foreign Application Priority Data
July 12, 1974 [FI] Finland.....2144/74--

In the Specification,

Column 2, after line 7, change the formula to read

-- $P \geqq 740 + 45\ (B-10)^{1.5}$ --

Column 2, before line 30, change the formula to read

-- $W = (0.02 \text{ to } 0.08)\ (P/B)^{0.63}$ --

In the Claims,

Claim 1, after line 39, change the formula to read

-- $P \geqq 740 + 45\ (B-10)^{1.5}$ --

Claim 1, after line 65, change the formula to read

-- $W = (0.02 \text{ to } 0.08)\ (P/B)^{0.63}$ --

Claim 2, change the formula to read

-- $W = (0.02 \text{ to } 0.04)\ (P/B)^{0.63}$ --

Claim 11, column 7, change the formula to read

-- $P \geqq 740 + 45\ (B - 10)^{1.5}$ --

UNITED STATES PATENT AND TRADEMARK OFFICE

CERTIFICATE OF CORRECTION

PATENT NO. : 4,351,255

DATED : September 28, 1982

INVENTOR(S) : Bengt Johansson, Arno Keinonen, Eero Makinen

It is certified that error appears in the above-identified patent and that said Letters Patent is hereby corrected as shown below:

Claim 11, column 8, change the formula to read

-- $W = (0.02 \text{ to } 0.08) \ (P/B)^{0.63}$ --.

Signed and Sealed this

Second Day of August 1983

[SEAL]

Attest:

GERALD J. MOSSINGHOFF

Attesting Officer

Commissioner of Patents and Trademarks